US006612974B2

(12) United States Patent
Hooper

(10) Patent No.: US 6,612,974 B2
(45) Date of Patent: Sep. 2, 2003

(54) ADJUSTABLE FOLDING STATION FOR CARDS

(75) Inventor: Dennis L. Hooper, Lee's Summit, MO (US)

(73) Assignee: Hallmark Cards Incorporated, Kansas City, MO (US)

( * ) Notice: Subject to any disclaimer, the term of this patent is extended or adjusted under 35 U.S.C. 154(b) by 45 days.

(21) Appl. No.: 09/775,539

(22) Filed: Feb. 1, 2001

(65) Prior Publication Data

US 2002/0103068 A1 Aug. 1, 2002

(51) Int. Cl.[7] ..... B65H 45/20; B31B 1/26

(52) U.S. Cl. ..... 493/413; 493/405; 493/418; 493/448; 493/450

(58) Field of Search ..... 493/405, 413, 493/451, 447, 448, 450, 418, 478, 453, 458, 430, 475, 476, 479

(56) References Cited

U.S. PATENT DOCUMENTS

| | | | | |
|---|---|---|---|---|
| 3,008,385 A | | 11/1961 | Pierce, Jr. | |
| 3,101,653 A | | 8/1963 | Burden | |
| 3,370,516 A | | 2/1968 | Peppler | |
| 3,640,189 A | | 2/1972 | Bowman | |
| 4,133,252 A | * | 1/1979 | Eckstein et al. | 493/226 |
| 4,369,613 A | * | 1/1983 | Gess | 156/548 |
| 4,540,396 A | * | 9/1985 | Berthelsen | 493/399 |
| 4,636,192 A | * | 1/1987 | Vogtlander et al. | 493/405 |
| 4,648,861 A | * | 3/1987 | Pierce | 493/333 |
| 4,674,998 A | | 6/1987 | Benedicenti | 493/164 |
| 4,764,073 A | * | 8/1988 | Garlichs et al. | 412/9 |
| 4,838,848 A | * | 6/1989 | Lenzi | 270/39.05 |
| 4,896,869 A | * | 1/1990 | Takekoshi | 269/309 |
| 5,094,658 A | * | 3/1992 | Smithe et al. | 493/248 |
| 5,259,827 A | * | 11/1993 | Staniszewski et al. | 493/23 |
| 5,391,137 A | * | 2/1995 | DePoy et al. | 493/405 |
| 5,632,713 A | | 5/1997 | Canning | 493/162 |
| 5,653,671 A | * | 8/1997 | Reuteler | 271/150 |
| 5,797,831 A | * | 8/1998 | Roberts et al. | 493/179 |

FOREIGN PATENT DOCUMENTS

| | | | | |
|---|---|---|---|---|
| JP | 05-170380 | * | 7/1993 | 493/413 |

* cited by examiner

*Primary Examiner*—Rinaldi I. Rada
*Assistant Examiner*—Paul Durand
(74) *Attorney, Agent, or Firm*—Pillsbury Winthrop LLP

(57) ABSTRACT

An adjustable card folding station includes an adjustable vacuum bed and moveable gates. The vacuum bed includes at least two sections that are movable with respect to each other to accommodate cards of different widths. Each section of the vacuum bed further includes multiple suction cups, each of which is individually connected to a vacuum supply. The vacuum supply independently controls each suction cup so that vacuum can be applied to selected or all suction cups such that cards of different lengths can be accommodated. The movable gates are pivotally mounted with respect to the vacuum bed and operated by motors to pivot 180 degrees from open to closed positions to fold the cards.

23 Claims, 6 Drawing Sheets

ADJUSTABLE FOLDING STATION FOR CARDS

FIELD OF THE INVENTION

The present invention relates generally to an adjustable folding station, and more particularly to a method and apparatus for folding cards of different sizes, shapes, and styles.

DESCRIPTION OF THE PRIOR ART

Social expression cards or greeting cards are manufactured and sold in a variety of sizes, shapes, and styles to provide consumers a wide selection. These cards are most popular during holidays and special occasions such as Christmas, Valentine's Day, birthday, anniversary, and the like. As can be expected, the card industry is and will continue to be a very lucrative and thriving industry.

During the manufacturing process, cards can be folded in different styles. For example, FIGS. 1–3 illustrate various folds that are common in the industry. FIG. 1 illustrates an example of a regular fold of a card. As illustrated, a card 2 is evenly divided along a score line 4 to form two panels 6*a*, 6*b*. A regular fold occurs when the panel 6*b* is folded over the panel 6*a* (or vice versa) along the score line 4. The score line 4 can be creased or indented prior to folding one panel over the other. The regular fold is one of the most commonly used folds in the card industry.

Next, FIG. 2 illustrates an example of a gate fold of a card. As illustrated, a card 12 is evenly divided along a pair of score lines 14*a*, 14*b* to form three panels 16*a*, 16*b*, 16*c*. A gate fold occurs when the first outer panel 16*c* is first folded over the center panel 16*b* along the score line 14*b*. Thereafter, the second outer panel 16*a* is folded over panels 16*b*, 16*c* along the other score line 14*a*. Again, the score lines 14*a*, 14*b* can be creased or indented prior to folding the panels over each other.

Alternatively, the card can be folded using a Z-fold method. A Z-fold occurs when the panels 16*b*, 16*c* are first folded over the panel 16*a* along the score line 14*a*. Thereafter, the panel 16*c* is back folded over panels 16*b*, 16*a* along the score line 14*b* to complete the Z-fold. FIG. 3 illustrates a side view of the Z-fold of the card 22.

Conventional folding stations that are used in the industry for folding cards will now be described. One conventional folding station is known as a buckle folder. A buckle folder pinches a creased card between two rollers and forces an end of the card against a stop. As the card continues to move against the stop, the card begins to buckle. The mechanical weakness provided by the crease allows the card to buckle at a predetermined point or the score line. As the card buckles outward, a nip roller grabs the card at the score line and completes the fold. Another conventional folding station is a belt folder, which uses a variety of rods and guides to move a panel of the card into its folded position as the card is pulled along by a series of opposing belts.

Although the conventional folding stations described above are widely used and accepted in the card industry, problems remain. For instance, conventional folding stations are not well suited to handle cards with different dimensions and styles. In other words, conventional folding stations are not flexible enough to fold cards of different sizes and shapes and cannot fold them using different folding techniques. Accordingly, there is a great need for an adjustable apparatus for folding cards of different sizes, shapes, and styles.

SUMMARY OF THE INVENTION

It is an object of the present invention to provide an adjustable folding station for folding cards of different sizes, shapes, and styles.

It is another object of the present invention to provide a method and apparatus that can fold cards of different sizes, shapes and styles with minimal adjustments.

It is yet another object of the present invention to provide a method and apparatus implementing an adjustable vacuum bed and individually controlled vacuum suction cups for folding cards of different sizes.

It is another object of the present invention to provide a method and apparatus implementing separately actuated gates for folding cards of different styles.

These and other objects of the present invention are obtained by providing a card folding station having an adjustable vacuum bed and moveable gates. The vacuum bed includes at least two sections that are mounted for horizontal movement back and forth with respect to each other to accommodate cards of different widths. Each section of the vacuum bed includes multiple suction cups, each of which is individually connected to a vacuum supply. The vacuum supply independently controls each suction cup so that vacuum can be applied to selected or all suction cups such that cards of different lengths can be accommodated. The movable gates are pivotally mounted with respect to the vacuum bed and operated by motors to pivot 180 degrees from open to closed positions. During operation, a card (or cards) is placed on the vacuum bed and held therein as one or both gates are sequentially actuated to fold the card.

BRIEF DESCRIPTION OF THE DRAWINGS

These and other objects and advantages of the present invention will become apparent and more readily appreciated from the following detailed description of the presently preferred exemplary embodiments of the invention taken in conjunction with the accompanying drawings, of which.

DETAILED DESCRIPTION OF THE PREFERRED EMBODIMENTS

Figure 1:
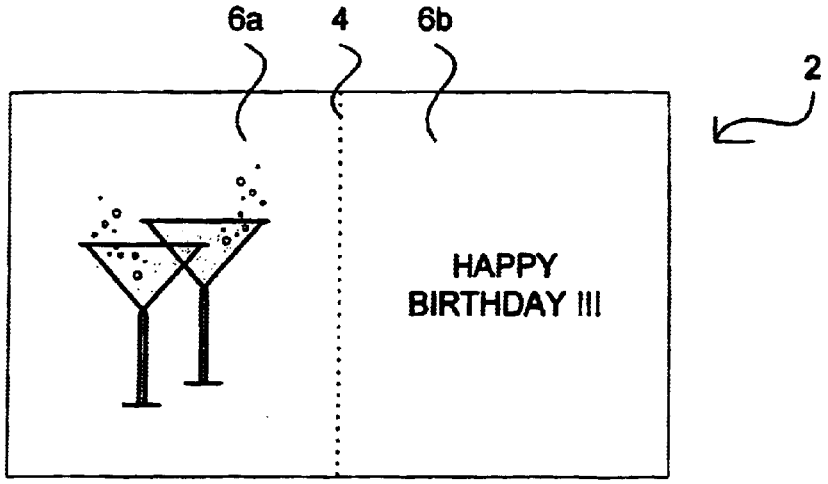
FIG. 1 illustrates a top view of a regular fold of a card.
Figure 2:
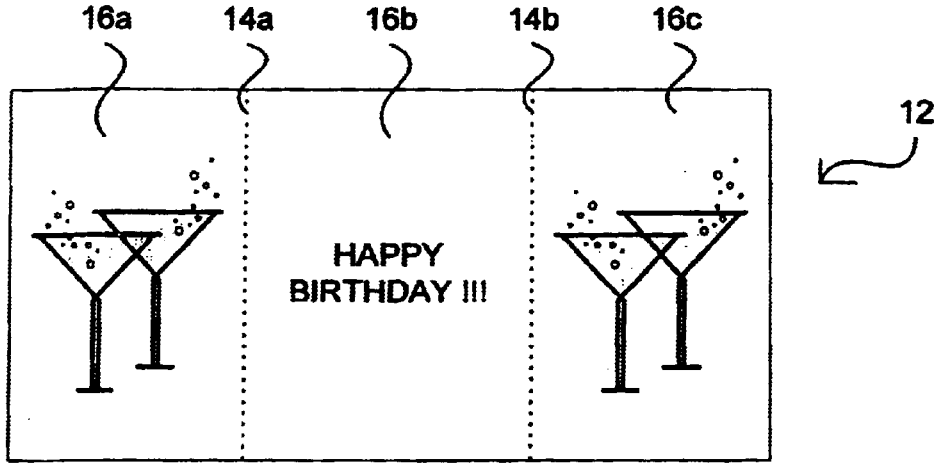
FIG. 2 illustrates a top view of a gate fold of a card.
Figure 3:
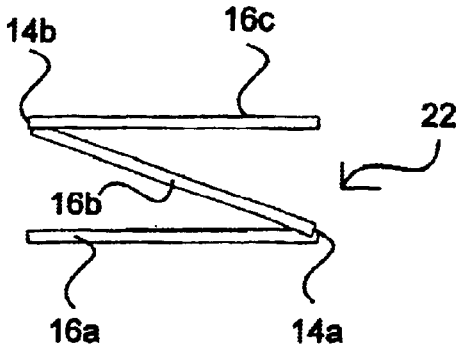
FIG. 3 illustrates a side view of a Z-fold of a card.

The present invention will now be described in greater detail, which will serve to further the understanding of the preferred exemplary embodiments of the present invention. As described elsewhere herein, various refinements and substitutions of the various embodiments are possible based on the principles and teachings herein.

The preferred embodiments of the present invention will now be described with reference to FIGS. 4–8, wherein like components, steps, etc. are designated by like reference numerals throughout the various figures. Further, specific details and parameters are provided herein and are intended to be explanatory rather than limiting.

The present invention relates to a method and apparatus for folding cards of different sizes, shapes, and styles. The apparatus is a card folding station having an adjustable vacuum bed and moveable gates. The vacuum bed is adjustable to accommodate cards of different widths. The vacuum bed includes multiple suction cups, which are individually connected to a vacuum supply. The vacuum supply independently controls each suction cup so that vacuum can be applied to all or selected suction cups to accommodate cards of different lengths. The movable gates are pivotally mounted with respect to the vacuum bed and operated by motors to pivot 180 degrees from open to closed positions to fold the cards. The presently preferred embodiments will now be described with reference to a card, although other folding items can be used in the present invention.

Figure 4:
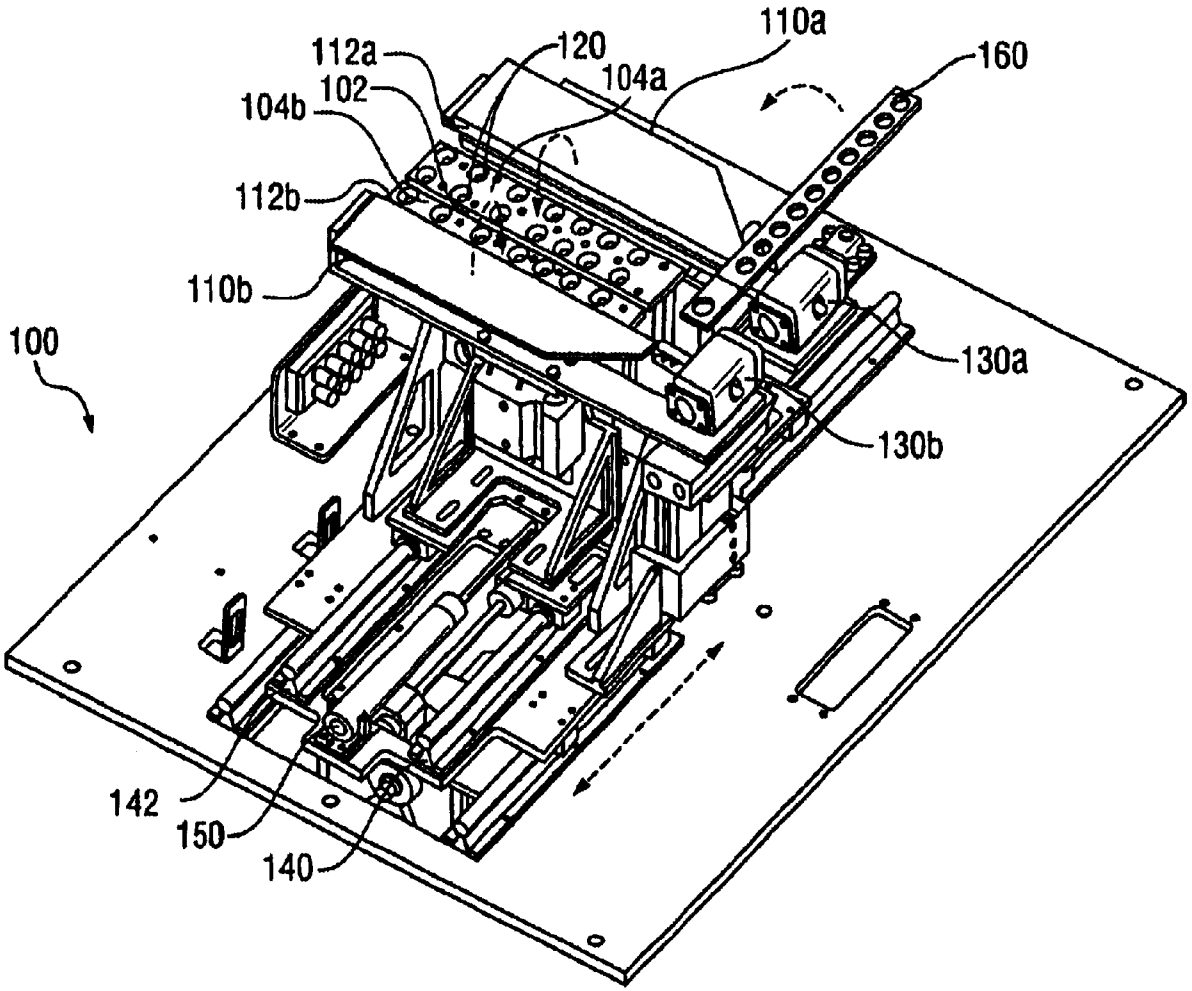
FIG. 4 illustrates a perspective view of an adjustable folding station in accordance with the present invention.
Figure 5:
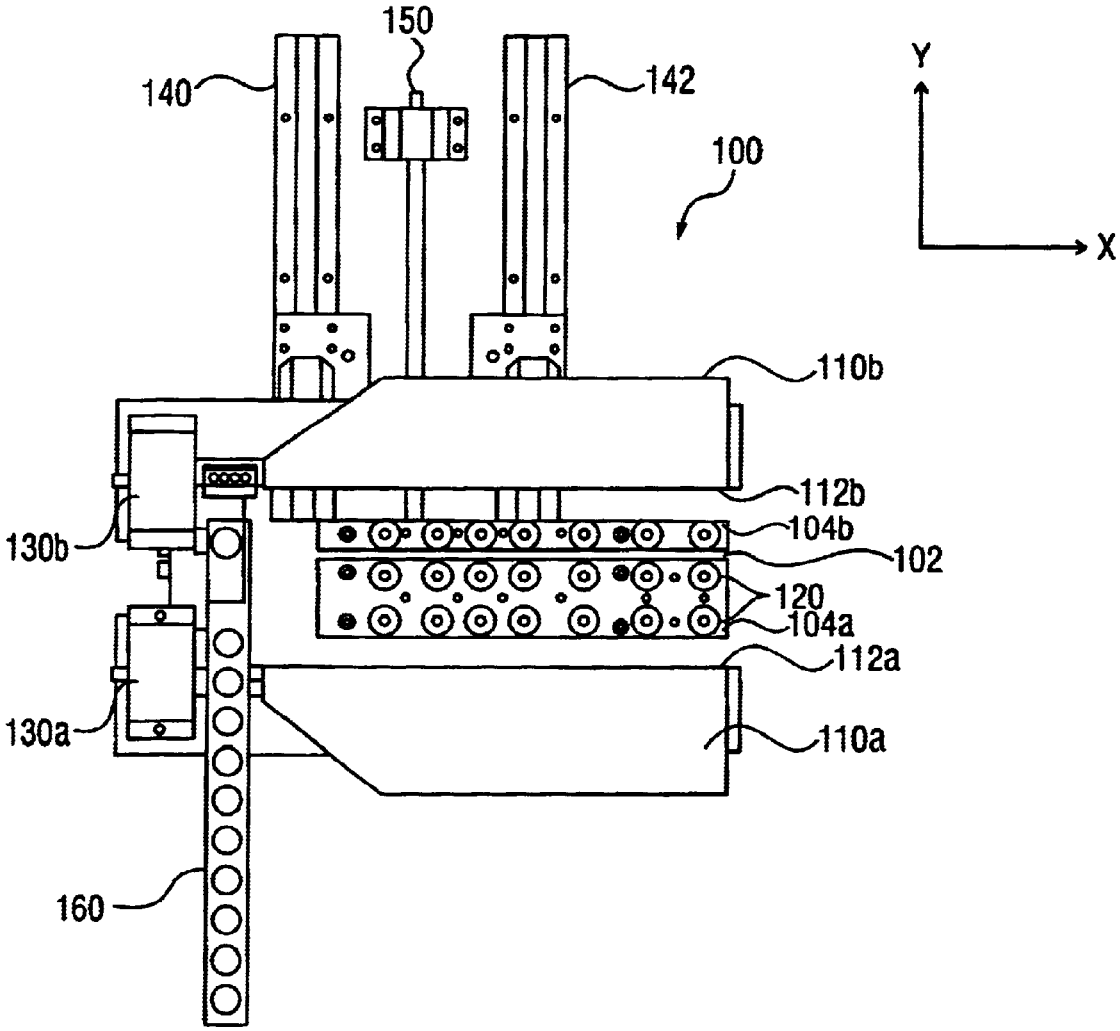
FIG. 5 illustrates a top view of the adjustable folding station of FIG. 4 in accordance with the present invention.

FIG. 4 illustrates a perspective view and FIG. 5 illustrates a top view of an adjustable folding station in accordance with the present invention. The folding station 100 includes a vacuum bed 102 and movable or folding gates 110*a*, 110*b*. One gate 110*a* is preferably fixed in its position, whereas the other gate 110*b* is adjustable in the y-direction using a servo driver (not shown) or other driving mechanism. The gates 110*a*, 110*b* as illustrated in FIGS. 4–5 are shown in their open positions and can rotate around the x-axis about its ends 112*a*, 112*b*, respectively. When the gates 110*a*, 110*b* are fully rotated 180 degrees toward the vacuum bed 102, the gates 110*a*, 110*b* are in their closed positions. The gates 110*a*, 110*b* are rotated or pivoted using motors such as a first gate actuator 130*a* and a second gate actuator 130*b*, respectively. Since gate actuators 130*a*, 130*b* are well known in the art, they will not be described in great detail herein. In other embodiments, different devices than the gate actuators 130*a*, 130*b* can be used to rotate the gates 110*a*, 110*b* from their open to closed positions and vice versa. The gate actuators 130*a*, 130*b* are connected to gates 110*a*, 110*b*, respectively, via shafts, rods, and the like (not shown) and provide the necessary torque to rotate the gates 110*a*, 110*b*. In addition, a Z-fold gate 160 may be used to assist in folding the card using the Z-fold process, which is described in greater detail later herein. In FIG. 4, the dotted-lint arrows show the movements that the gates 110*a*, 110*b* and Z-fold gate 160 are capable of making.

The vacuum bed 102 includes two sections, a fixed bed section 104*a* and an adjustable bed section 104*b*. In other embodiments, the bed 104*a* can be adjustable and the bed 104*b* can be fixed. Both the fixed bed 104*a* and the adjustable bed 104*b* include multiple suction cups 120 along the x and y directions of the beds 104*a*, 104*b*. The suction cups 120 are individually connected to a vacuum supply (not shown). The vacuum supply is used to independently control each suction cup so that vacuum can be applied to selected or all suction cups 120, depending on the length of the card.

As is well known in the industry, the suction cups 120 are used to secure the card within the vacuum bed 102. The suction cups 120 are generally made from any suitable material such as rubber, polymer, or other materials that are capable of securing the card on the vacuum bed 102. Depending on the length of the card, vacuum is provided to selected suction cups 120 for securing the card. For example, if the length of the card extends along the entire length (i.e, x-direction) of the vacuum bed 102, then the vacuum supply can provide vacuum to all the suction cups 120. Alternatively, if the length of the card is relatively short, then the vacuum supply can provide vacuum to selected suction cups 120 that are covered by the card when the card is positioned on the vacuum bed 102. In this manner, the folding station 100 can accommodate cards with different lengths by way of supplying vacuum to selected or all suction cups 120.

The folding station 100 can also be used to accommodate cards with different widths using the adjustable gate 110*b* and the adjustable vacuum bed 104*b*. As illustrated, the adjustable gate 110*b* and the adjustable vacuum bed 104*b* are connected to each other and a pair of linear bearings 140, 142. In another embodiment, the adjustable gate 110*b* and the adjustable vacuum bed 104*b* may not be connected together and move about independently. A mechanism such as a ball screw 150 can be used to drive the adjustable gate 110*b* and the adjustable vacuum bed 104*b* in the y-direction. In this manner, the vacuum bed 102 can accommodate cards of different widths by adjusting the gate 110*b* and the vacuum bed 104*b*. As a result, cards of different widths and lengths can be secured and folded using the folding station 100. It should also be noted that the widths and the lengths of the cards vary depending on the card manufacturers' specifications.

Although the present invention describes one ball screw 150 and a pair of linear bearings 140, 142 to adjust the gate 110*b* and bed 104*b* in the y-driection, it is understood that any suitable number of ball screws and linear bearings, or a mechanism that does not rely on a ball screw and/or linear bearings are intended to be within the scope and spirit of the present invention. Also, although only two vacuum bed sections 104*a*, 104*b* and two gates 110*a*, 110*b* are illustrated herein, it is understood that in other embodiments more or less than two bed sections and gates can be used. In addition, other similar components/devices may be substituted for the ones described above.

Methods for folding the cards in different styles will now be described with reference to FIGS. 6–8. Reference will also be made concurrently to FIGS. 1–5 for a more complete understanding of the methods according to the present invention.

Figure 6:
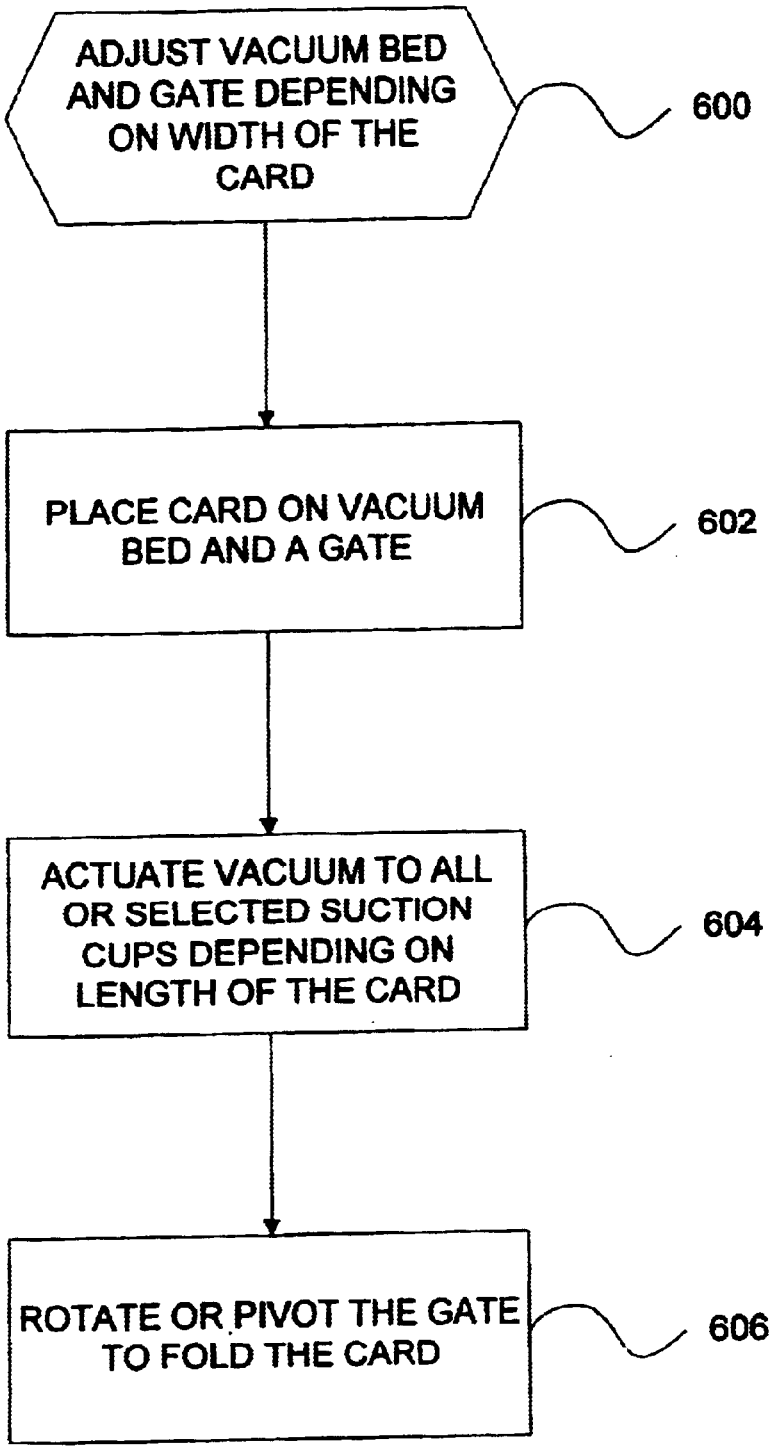
FIG. 6 illustrates a regular folding process of a card using the adjustable folding station in accordance with the present invention.

FIG. 6 illustrates a regular folding process of a card using the adjustable folding station in accordance with the present invention. During operation, the vacuum bed 104*b* and the gate 110*b* are adjusted, depending on the width of the card, before placing the card thereon in step 600. Thereafter, the card 2 (or multiple cards) is placed on the vacuum bed 102 and the gate 110*a* (or gate 110*b*) in step 602. In other words, one panel 6*a* of the card 2 is placed on the vacuum bed 102 and the other panel 6*b* is placed on the gate 110*a* (or gate 110*b*). The score line 4 on the card 2 is preferably positioned directly above the gate edge 112*a* (or gate edge 112*b*). Next, the supply vacuum actuates the vacuum to all or selected suction cups 120, depending on the length of the card, to secure the card therein in step 604. In step 606, the gate 110*a* (or gate 110*b*) is pivoted or rotated 180 degrees from its open to closed position using the gate actuator 130*a* (or gate actuator 130*b*) to fold the card, resulting in the completion of the regular fold.

Figure 7:
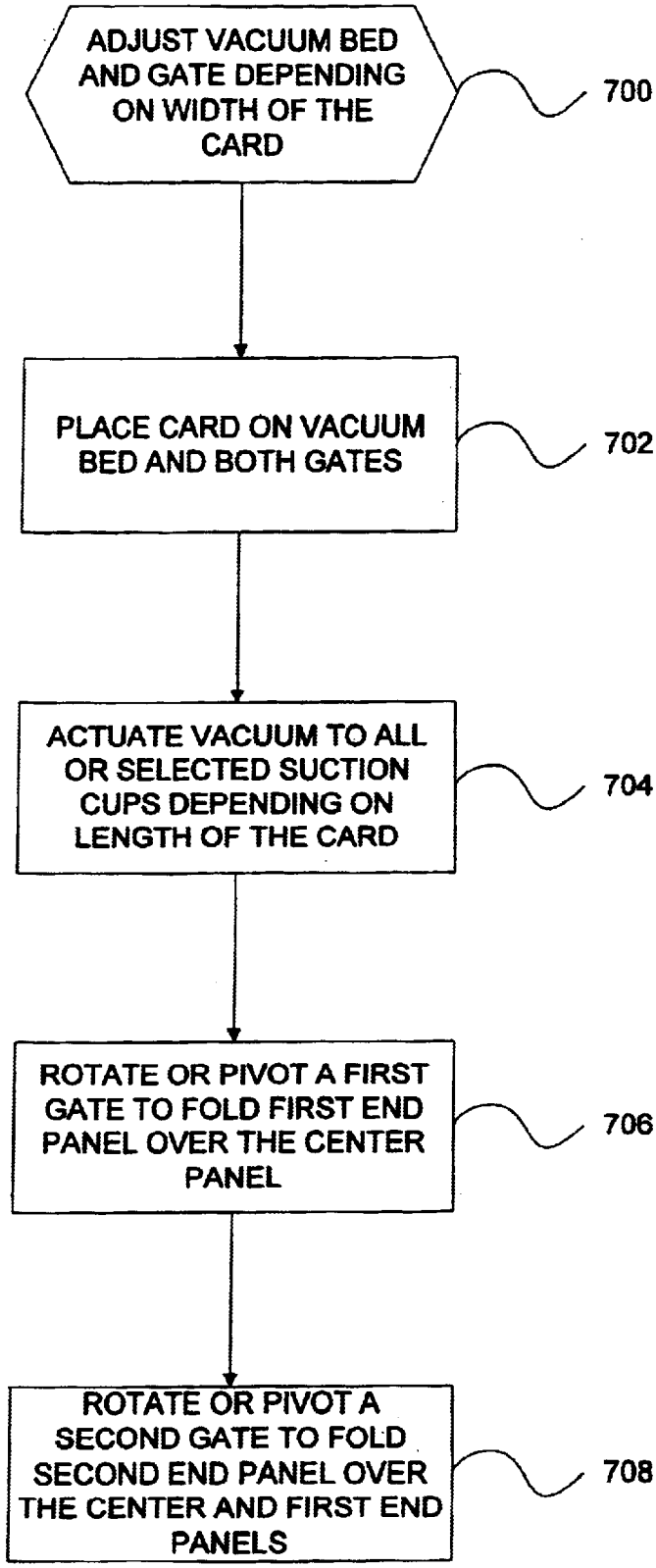
FIG. 7 illustrates a gate folding process of a card using the adjustable folding station in accordance with the present invention.

FIG. 7 illustrates a gate folding process of a card using the adjustable folding station in accordance with the present invention. During operation, the vacuum bed 104*b* and the gate 110*b* are adjusted, depending on the length of the card, prior to placing the card thereon in step 700. Thereafter, the card 12 (or multiple cards) is placed on the vacuum bed 102 and the gates 110*a*, 110*b* in step 702. The center panel 16*b* is placed on the vacuum bed 102 and the outer panels 16*a*,

16*c* are placed on the gates 110*a,* 110*b,* respectively. The score lines 14*a,* 14*b* are preferably positioned directly above the gate edges 112*a,* 112*b,* respectively. Next, the supply vacuum actuates the vacuum to all or selected suction cups 120, depending on the length of the card, to secure the card therein in step 704. In step 706, the gate 110*a* is pivoted or rotated 180 degrees using the gate actuator 130*a* to fold the panel 16*a* over the panel 16*b*. Next, in step 708, the gate 110*b* is likewise pivoted or rotated 180 degrees using the gate actuator 130*b* to fold the panel 16*c* over panels 16*b,* 16*a,* resulting in the completion of the gate fold.

Figure 8:
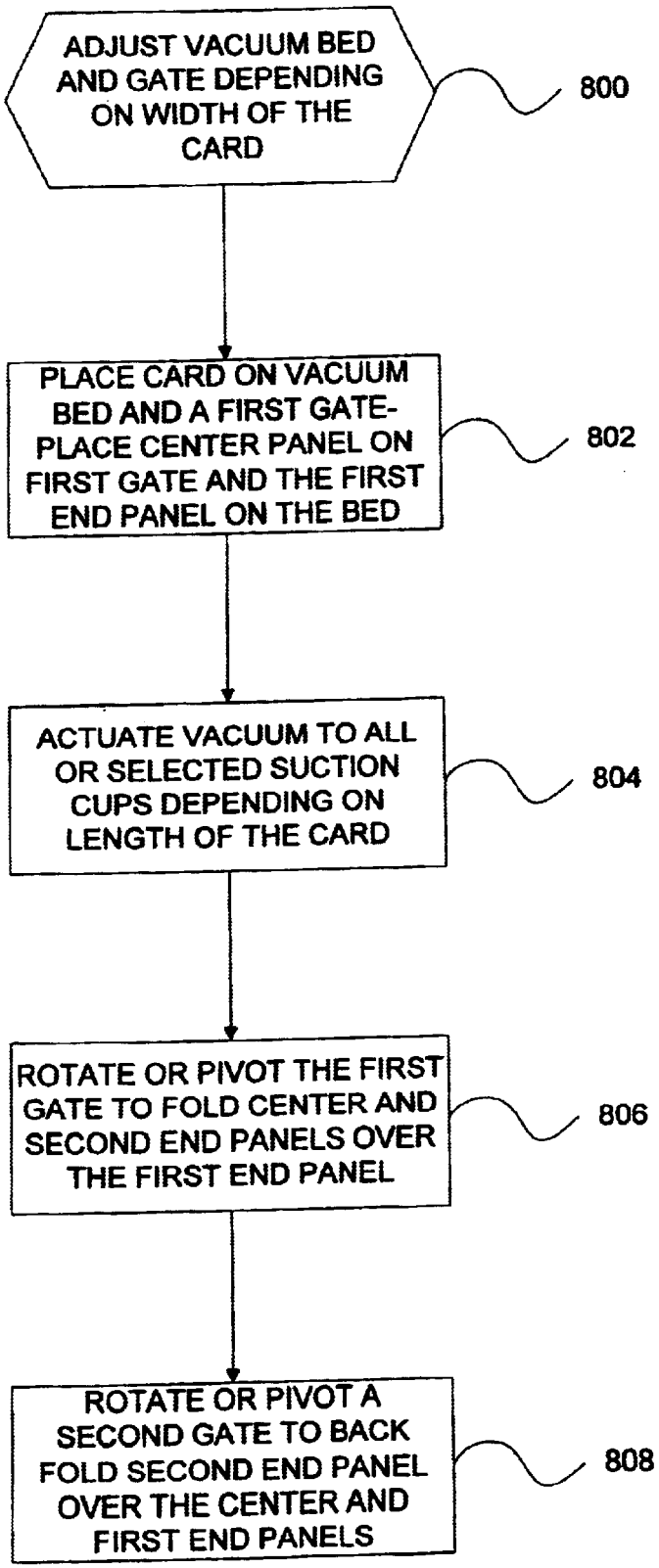
FIG. 8 illustrates a Z-folding process of a card using the adjustable folding station in accordance with the present invention.

FIG. 8 illustrates a Z-folding process of a card using the adjustable folding station in accordance with the present invention. During operation, the vacuum bed 104*b* and the gate 110*b* are adjusted, depending on the length of the card, before placing the card thereon in step 800. Thereafter, the card 22 (or multiple cards) is placed on the vacuum bed 102 and gate 110*a* in step 802. In other words, the center panel 16*b* is placed on the gate 110*a* and the first outer panel 16*a* is placed on the vacuum bed 102. The score line 14*a* is preferably positioned directly above the gate edge 112*a*. Next, the supply vacuum actuates the vacuum to all or selected suction cups 120, depending on the length of the card, to secure the card therein in step 804. In step 806, the gate 110*a* is pivoted or rotated 180 degrees using the gate actuator 130*a* to fold the center and second end panels 16*b,* 16*c* over the first end panel 16*a*. Next, in step 808, the gate 110*b* is likewise pivoted or rotated 180 degrees using the gate actuator 130*b* to back fold the second end panel 16*c* over the first end and center panels 16*a,* 16*b,* resulting in the completion of the Z-fold. Alternatively, before back folding the second end panel 16*c,* the Z-fold gate 160 can be rotated counter-clockwise about 90 degrees (i.e., perpendicular to its position shown in FIGS. 4–5) to secure the card 22. As shown, the Z-fold gate 160 is positioned in a slightly higher plane than the gates 110*a,* 110*b*. In this manner, the Z-fold gate 160 not only secures the card 22, but assists the gate 110*b* in back folding the second end panel 16*c* over the first end and center panels 16*a,* 16*b*.

It is to be understood that in the foregoing discussion and appended claims, the terms "card" include, but are not limited to, greeting cards, invitations, letters, flyers, etc. Also, it is understood that the folding gates can rotate about or approximately 180 degrees (or about 90 degrees for Z-fold gate) to perform the folding functions described herein. Although various preferred embodiments of the present invention have been disclosed for illustrative purposes, those skilled in the art will appreciate that various modifications, additions and/or substitutions are possible without departing from the scope and spirit of the present invention as disclosed in the claims.

In the previous descriptions, numerous specific details and examples are set forth such as specific components, devices, steps, folds, cards, etc., to provide a thorough understanding of the present invention. However, as one having ordinary skill in the art would recognize, the present invention can be practiced without resorting to the details and examples specifically set forth. Those skilled in the art will readily appreciate that many modifications of the exemplary embodiments are possible without materially departing from the novel teachings and advantages of this invention.

What is claimed:

1. A card folding station for accommodating a card having a width and a length, comprising:

a vacuum bed having an adjustable bed section and a fixed bed section, the adjustable bed section and the fixed bed section having suction cups for securing the card, the adjustable bed section and the fixed bed section defining a plane, and the adjustable bed section being movable in the plane with respect to the fixed bed section;

a pair of rotatable gates, wherein the first gate is fixed and the second gate is moveable in the plane with respect to the first gate;

a pair of gate actuators, each actuator connected to one of the pair of gates;

a vacuum supply connected to the suction cups for selectively actuating some or all of the suction cups depending on the length of the card; and a pair of linear bearings and a ball screw connected to at least one of the adjustable bed section and the second gate.

2. A card folding station according to claim 1, wherein the second gate is connected to the adjustable bed section.

3. A card folding station according to claim 1, wherein the pair of linear bearings and the ball screw are used to move the second gate and the adjustable bed in the plane.

4. A card folding station according to claim 1, wherein the pair of rotatable gates are adapted to be rotated about 180 degrees.

5. A card folding station according to claim 1 further comprising a Z-fold gate for securing the card during a Z-fold process.

6. A card folding station according to claim 5, wherein the Z-fold gate is adapted to be rotated about 90 degrees.

7. A card folding station according to claim 1, wherein the suction cups comprise materials such as rubber and polymer.

8. A card folding station for accommodating a card having a width and a length, comprising:

a vacuum bed having a first bed section and a second bed section, the first bed section and the second bed section having suction cups, the first bed section and the second bed section defining a plane, and said first bed section being movable in said plane with respect to said second bed section;

a pair of gates, each of said gates being rotatable about axes in the plane, and a first of the gates being moveable in the plane with respect to a second of the gates;

means for rotating the gates;

means for selectively supplying vacuum to some or all of the suction cups depending on the length of the card; and means for moving the at least one of said second bed section and said second gate to accommodate the width of the card.

9. A card folding station according to claim 8, wherein the second gate is connected to the second bed section.

10. A card folding station according to claim 8, wherein the means for rotating the pair of gates comprises one or more gate actuators.

11. A card folding station according to claim 8, wherein the means for selectively supplying vacuum comprises a vacuum supply connected to the suction cups.

12. A card folding station according to claim 8, wherein the means for moving at least one of the second bed section and the second gate comprises a pair of linear bearings and a ball screw.

13. A card folding station according to claim 8 further comprising a Z-fold gate for securing the card during a Z-fold process.

14. A method of securing a card having a width and length on a folding station, the station having a first gate, a first vacuum bed, a second gate, second vacuum bed, and suction cups placed on the vacuum beds, the vacuum beds defining a plane, the first vacuum bed being moveable in the plane with respect to the second vacuum bed and the first gate being movable in the plane with respect to the second gate, the method comprising:

moving at least one of the first gate the first vacuum bed in a linear direction to accommodate the width of the card;

placing the card on the beds and at least one of the gates; and selectively supplying vacuum to at least some of the suction cups depending on the length of the card.

15. A method according to claim 14 further comprising moving at least one of the first gate and the first vacuum bed using a pair of linear bearings and a ball screw.

16. A method of folding a card having a width, a length, and panels on a folding station, the station having a first gate, a first vacuum bed, a second gate, a second vacuum bed, and suction cups placed on the vacuum beds, said vacuum beds defining a plane and said second gate and said second vacuum bed being moveable in said plane with respect to said first gate and said first vacuum bed, the method comprising:

moving at least one of the second gate and the second vacuum bed in the plane to accommodate the width of the card;

placing the card on the beds and at least one of one the gates;

selectively supplying vacuum to at least some of the suction cups depending on the length of the card to secure the card; and sequentially rotating at least one of the gates to fold at least one of the panels over another of the panels.

17. A method according to claim 16 further comprising moving at least one of the second gate and the second vacuum bed using a pair of linear bearings and a ball screw.

18. A method according to claim 16, wherein the placing step further comprises positioning a first panel of the card on the beds and a second panel of the card on one gate for a regular folding process.

19. A method according to claim 18, wherein the sequentially rotating step comprises rotating the one gate about 180 degrees to fold the second panel over the first panel.

20. A method according to claim 16, wherein the placing step further comprises positioning a center panel of the card on the beds and the first and second end panels of the card on each gate, respectively, for a gate folding process.

21. A method according to claim 20, wherein the sequentially rotating step comprises:

first rotating one gate about 180 degrees to fold the first end panel over the center panel; and second rotating the other gate about 180 degrees to fold the second end panel over the first end and center panels.

22. A method according to claim 16, wherein the placing step further comprises positioning a first end panel of the card on the beds and a center panel of the card on one gate for a Z-folding process.

23. A method according to claim 22, wherein the sequentially rotating step comprises:

first rotating the one gate about 180 degrees to fold the center panel over the first end panel, whereby a second end panel is positioned on the other gate; and second rotating the other gate about 180 degrees to fold the second end panel over the first end and center panels.

* * * * *

UNITED STATES PATENT AND TRADEMARK OFFICE

CERTIFICATE OF CORRECTION

PATENT NO. : 6,612,974 B2
DATED : September 2, 2003
INVENTOR(S) : Dennis L. Hooper It is certified that error appears in the above-identified patent and that said Letters Patent is hereby corrected as shown below:

Column 7,
Line 29, please change "at least one of one the" to -- at least one of the --

Signed and Sealed this

Fourteenth Day of October, 2003

JAMES E. ROGAN
*Director of the United States Patent and Trademark Office*